US007084831B2

(12) United States Patent
Takagi et al.

(10) Patent No.: US 7,084,831 B2
(45) Date of Patent: Aug. 1, 2006

(54) WIRELESS DEVICE HAVING ANTENNA

(75) Inventors: Naoyuki Takagi, Joyo (JP); Yuki Satoh, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/023,494

(22) Filed: Dec. 29, 2004

(65) Prior Publication Data

US 2005/0190107 A1 Sep. 1, 2005

(30) Foreign Application Priority Data

Feb. 26, 2004 (JP) ..... 2004-051083

(51) Int. Cl.
*H01Q 1/24* (2006.01)
*H01Q 21/00* (2006.01)
*H01Q 1/50* (2006.01)

(52) U.S. Cl. ..... 343/860; 343/853; 343/702

(58) Field of Classification Search ..... 343/702, 343/725, 745, 749, 852, 853, 860
See application file for complete search history.

(56) References Cited

U.S. PATENT DOCUMENTS 6,154,177 A * 11/2000 Saito et al. ..... 343/702
6,198,442 B1 3/2001 Rutkowski et al. ..... 343/702
6,873,299 B1 * 3/2005 Dakeya et al. ..... 343/745
6,914,570 B1 * 7/2005 Asrani et al. ..... 343/702
2002/0163470 A1 11/2002 Nagumo et al. ..... 343/702
2003/0063030 A1 4/2003 Stoiljkovic et al. .. 343/700 MS
2005/0085204 A1 * 4/2005 Poilasne et al. ..... 455/193.1

FOREIGN PATENT DOCUMENTS

EP 1 289 061 3/2003
JP 2003-101335 4/2003
WO 03/055087 7/2003

* cited by examiner

*Primary Examiner*—Shih-Chao Chen
(74) *Attorney, Agent, or Firm*—Wenderoth, Lind & Ponack, L.L.P.

(57) ABSTRACT

A wireless device includes a first antenna element resonating with a first frequency, a first feeding point coupled to the first antenna element and disposed on a ground plane in the wireless device, and a first matching circuit of which its first end is coupled to the first feeding point. The wireless device also includes a second antenna element resonating a second frequency higher than the first frequency, a second feeding point coupled to the second antenna element and disposed on the ground plane, a second matching circuit of which one end is coupled to the second feeding point, and a radio circuit coupled via a transmission line to a common connection point shared by respective second ends of the first and second matching circuits.

5 Claims, 3 Drawing Sheets

WIRELESS DEVICE HAVING ANTENNA

FIELD OF THE INVENTION

The present invention relates to a wireless device having an antenna, and more particularly, it relates to a wireless device, such as a cellular phone, to be used in a mobile communication.

BACKGROUND OF THE INVENTION

Recently, the mobile communication including cellular phones provides versatile services in data communication, such as communications in audio, text and dynamic picture. This market trend requires a more sophisticated wireless device, in particular, a wireless device having a more sophisticated antenna is demanded. Because the antenna is a gate for receiving and transmitting an electromagnetic wave, and its performance is one of large number of factors affecting the performance of the wireless device.

A conventional wireless device is described hereinafter with reference to FIG. 3 which illustrates schematically the conventional wireless device having an antenna. In FIG. 3, antenna 103 is placed side by side with ground plane 108. Antenna 103 includes antenna element 101 for resonating with a first frequency and antenna element 102 for resonating with a second frequency. Antenna 103 is coupled to feeding point 104 disposed on ground plane 108, and coupled to radio circuit 107 via matching circuit 105 and transmission line 106. The structure discussed above forms wireless device 109.

As discussed above, the construction of conventional wireless device 109 allows a single feeding point 104 to feed both of first antenna element 101 and second antenna element 102 with electricity. First antenna element 101 resonates with the frequency ranging from 880 MHz–960 MHz, namely, GSM (Global System of Mobile Communication) band, and second antenna element 102 resonates with the frequency ranging from 1710 MHz–1880 MHz, namely, DCS (Digital Communication System) band.

When the wireless device discussed above receives a frequency of GSM band, first antenna element 101 energizes an electric current using an electromagnetic wave received, and the current runs to radio circuit 107 via feeding point 104, matching circuit 105 and transmission line 106. As a result, the electromagnetic wave is received by the wireless device.

When a frequency of GSM band is transmitted from the wireless device, a signal generated in radio circuit 107 is conveyed to first antenna element 101 via transmission line 106, matching circuit 105 and feeding point 104. First antenna element 101 energizes the signal into an electromagnetic wave, which is then radiated, thereby carrying out a transmission.

When the wireless device receives/transmits a frequency of DCS band, second antenna element 102 receives/transmits an electromagnetic wave in the same manner as the case of receiving/transmitting an electromagnetic wave of GSM band.

As such, conventional wireless device 109 deals with the two kinds of frequencies, i.e., GSM and DCS. Japanese patent application non-examined publication No. 2003-101335 discloses one of the prior art related to what is discussed above.

However, since the construction of the conventional wireless device allows one single feeding point 104 to feed both of antenna elements 101 and 102 with electricity, the coupling between elements 101 and 102 is strengthened. Therefore, when an electromagnetic wave is radiated from one antenna, the power radiated travels to the other antenna, so that the one antenna tends to invite some loss in its radiating power.

Further, matching circuit 105 adjusts two different electromagnetic waves independently by itself in order to obtain two different and desirable resonant frequencies, so that when a first resonance frequency is adjusted, a second one changes synchronously. As a result, it is difficult to adjust only the first resonance frequency efficiently and independently of the second one.

SUMMARY OF THE INVENTION

The present invention aims to overcome the problems discussed above, and provides a wireless device that can reduce a coupling loss of two antenna elements and adjust a frequency independently of other frequencies to a desirable resonance frequency although the wireless device handles numbers of frequencies. The wireless device of the present invention comprises the following elements:

(a) a first antenna element for resonating with a first frequency;

(b) a first feeding point coupled to the first antenna element and disposed on a ground plane in the wireless device;

(c) a first matching circuit of which first end is coupled to the first feeding point;

(d) a second antenna element for resonating with a frequency higher than the first frequency;

(e) a second feeding point coupled to the second antenna element and disposed on the ground plane in the wireless device;

(f) a second matching circuit of which first end is coupled to the second feeding point; and (g) a radio circuit coupled to a common contact shared by a second end of the first matching circuit and a second end of the second matching circuit via a transmission line.

The construction discussed above has two feeding points corresponding to the first antenna element and the second antenna element, respectively and independently, so that a coupling loss between the two antenna elements can be reduced. On top of that, the construction has two matching circuits corresponding to the two antenna elements, respectively and independently, namely, the first matching circuit and the second one. It is easy to adjust two different resonant frequencies independently.

DETAILED DESCRIPTION OF PREFERRED EMBODIMENT

Figure 1:
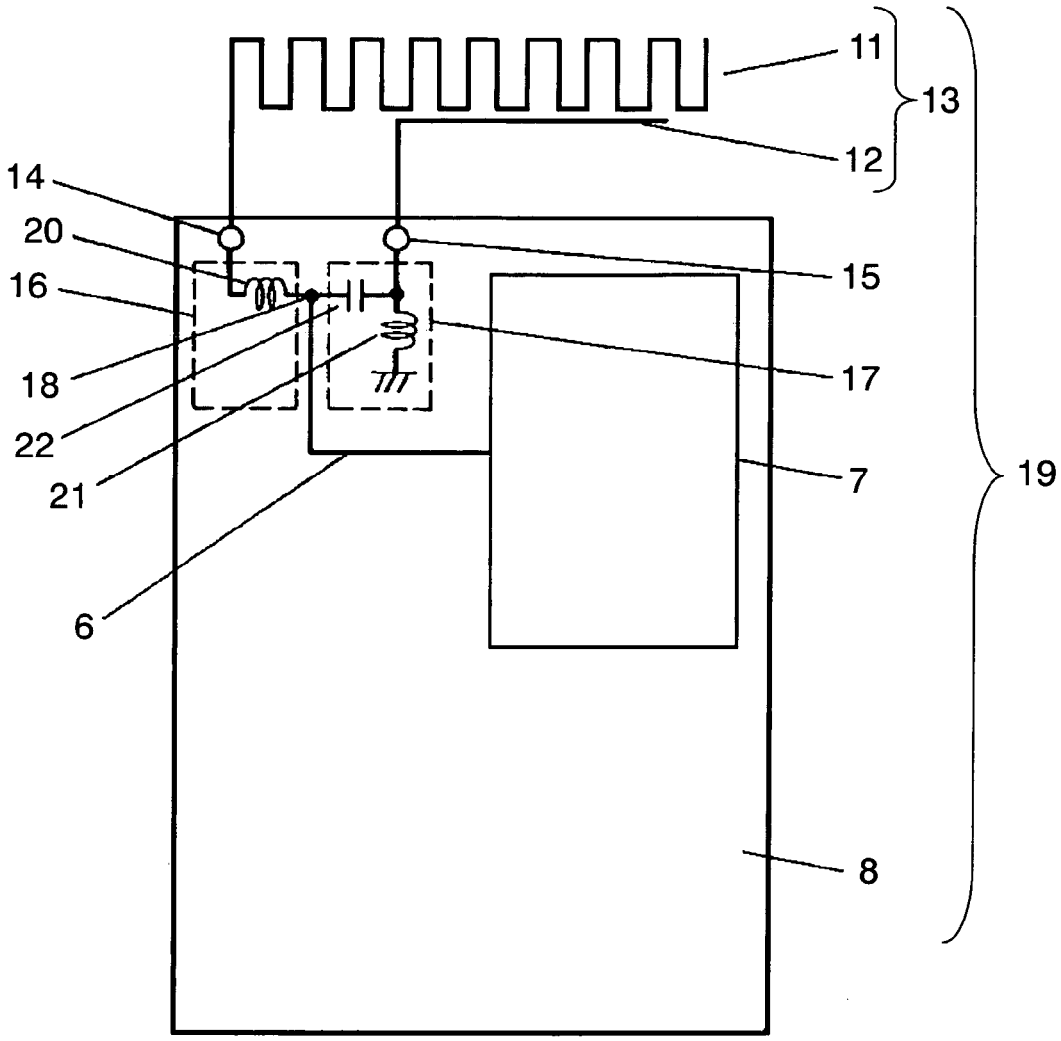
FIG. 1 shows schematically a wireless device in accordance with an exemplary embodiment of the present invention.
Figure 2:
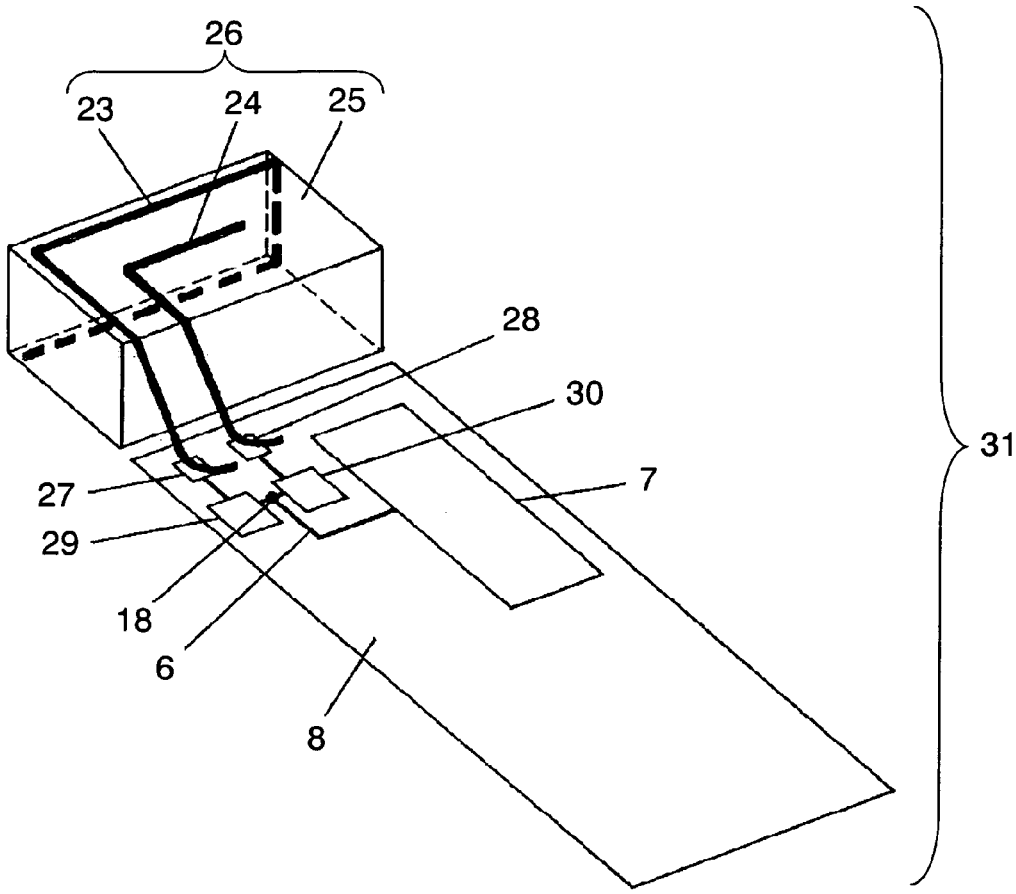
FIG. 2 shows a perspective view illustrating a wireless device having an antenna made from antenna elements made of spring metal and insulating resin, in accordance with an exemplary embodiment of the present invention.
Figure 3:
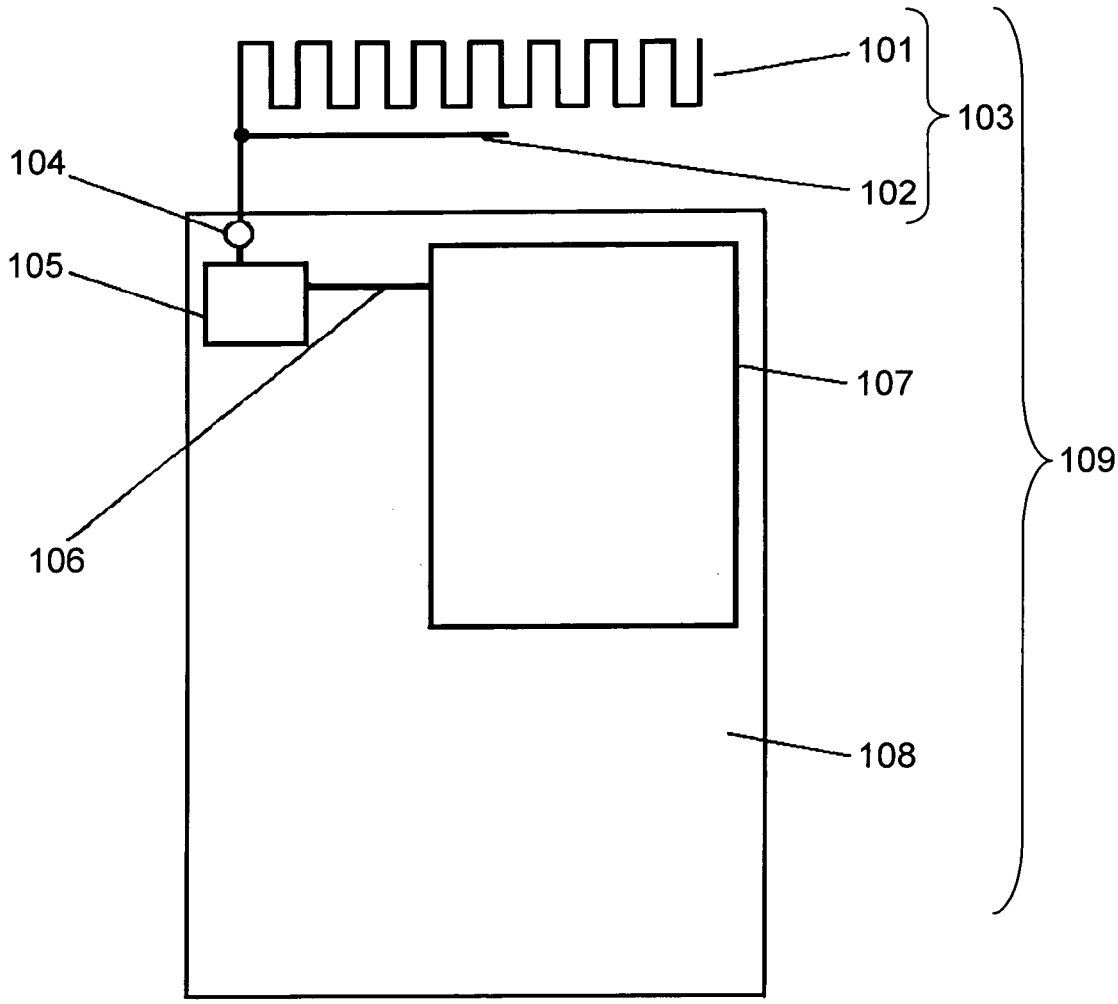
FIG. 3 PRIOR ART
FIG. 3 shows schematically a conventional wireless device having an antenna.

An exemplary embodiment of the present invention is demonstrated hereinafter with reference to the accompanying drawings. FIG. 1 shows schematically a wireless device in accordance with the exemplary embodiment of the present invention. FIG. 2 shows a perspective view illustrating a wireless device having an antenna comprising antenna elements made of spring metal and insulating resin, in accordance with the exemplary embodiment of the present invention.

Wireless device 19 of the present invention comprises the following elements:

(a) first antenna element 11 for resonating with a first frequency;

(b) first feeding point 14 coupled to first antenna element 11 and disposed on ground plane 8 in wireless device 19;

(c) first matching circuit 16 of which first end is coupled to first feeding point 14;

(d) second antenna element 12 for resonating with a frequency higher than the first frequency;

(e) second feeding point 15 coupled to second antenna element 12 and disposed on ground plane 8;

(f) second matching circuit 17 of which first end is coupled to second feeding point 15; and (g) radio circuit 7 coupled to common contact 18 shared by a second end of first matching circuit 16 and a second end of second matching circuit 17 via transmission line 6.

The foregoing construction of wireless device 19 of the present invention is detailed hereinafter. In FIG. 1, antenna 13 is placed side by side with ground plane 8, and includes first antenna element 11 resonating with a first frequency and second antenna element 12 resonating with a second frequency.

First antenna element 11 is coupled to first feeding point 14 placed on ground plane 8, and first feeding point 14 is coupled to a first end of first matching circuit 16. On the other hand, second antenna element 12 is coupled to second feeding point 15 placed on ground plane 8, and second feeding point 15 is coupled to a first end of second matching circuit 17. A second end of first matching circuit 16 and a second end of second matching circuit 17 are coupled to each other at common connection point 18, which is coupled to radio circuit 7 via transmission line 6.

First antenna element 11 resonates with the first frequency, i.e., GSM band of 880 MHz–960 MHz, and second antenna element 12 resonates the second frequency higher than the first one, i.e., DCS band of 17710 MHz–1880 MHz.

First matching circuit 16 is formed of inductor 20 coupled between first feeding point 14 and common connection point 18. Second matching circuit 17 is formed of capacitor 22 and inductor 21. Capacitor 22 is coupled between second feeding point 15 and common connection point 18, and inductor 21 is coupled between second feeding point 15 and ground plane 8.

Wireless device 19 having the structure discussed above can receive or transmit the frequency of GSM band because first antenna element 11 resonates with the GSM frequency. It can also receive or transmit the frequency of DCS band because second antenna element 12 resonates with the DCS frequency.

According to the exemplary embodiment, wireless device 19 has two feeding points corresponding to first antenna element 11 and second antenna element 12 respectively and independently, so that a coupling loss between the two antenna elements 11 and 12 can be reduced. On top of that, wireless device 19 has two matching circuits 16 and 17 corresponding to two antenna elements 11 and 12 respectively and independently, thereby adjusting two different resonant frequencies independently with ease.

The foregoing structure of matching circuits 16 and 17 produces the following advantages. When wireless device 19 handles the first frequency, second antenna element 12 is electrically isolated from transmission line 6 by capacitor 22 of second matching circuit 17. Further, second antenna element 12 is electrically coupled to ground plane 8 by inductor 21 of second matching circuit 17, so that second antenna element 12 works as a parasitic antenna element. As a result, the compound resonance between first antenna element 11 and second antenna element 12 working as a parasitic antenna element can widen a band of the first frequency.

Inductor 20 of first matching circuit 16 works at the first frequency such that the resonance frequency of first antenna element 11 can be lowered, thereby downsizing first antenna element 11. Inductor 20 also works as a high impedance to the second frequency, so that it advantageously shuts off the electrical transmission of the second frequency to first antenna element 11. This mechanism allows adjusting the two frequencies independently more easily.

The placement of the passive components such as capacitors and inductors of matching circuits 16 and 17 is not limited to what is shown in FIG. 1, but the passive components can be placed arbitrarily so that the impedance can be adjusted. In this case, the foregoing idea is desirably adopted.

First antenna element 11 shown in FIG. 1 is formed of a meander antenna. However, antenna element 11 is not limited to this construction, e.g., first antenna element 23 is formed of a folded monopole antenna as shown in FIG. 2. It can be also any type of linear-, helical-, meander-, and planar-antenna or it can be constructed by combining those antenna types. Second antenna element 12 can be also any type of antenna as discussed above. A part of first antenna element 11 or a part of second antenna element 12 is grounded to ground plane 8, so that the antenna element can work as an inverted F antenna. This construction allows adjusting the impedance more flexibly.

FIG. 2 shows a perspective view illustrating a wireless device, comprising an antenna formed of antenna elements made of spring metal and insulating resin, in accordance with the exemplary embodiment of the present invention. In this embodiment shown in FIG. 2, first antenna element 23 and second antenna element 24 are formed together with insulating resin 25, thereby forming antenna 26. According to this construction, insulating resin 25 suppresses deformation of first antenna element 23 and second antenna element 24, and antenna 26 can be downsized with ease thanks to the dielectric constant of insulating resin 25.

On top of that, first antenna element 23 and second antenna element 24 are made of spring metal such as phosphor bronze. An end of each antenna element is coupled to first feeding point 27 and second feeding point 28, respectively, by applying pressure. This construction allows antenna 26 to be coupled to respective feeding points 27 and 28 with ease free from soldering.

In wireless device 31 in accordance with this exemplary embodiment, a first end of first matching circuit 29 and a first end of second matching circuit 30 are coupled to first feeding point 27 and second feeding point 28 respectively. Second ends of each of circuits 29 and 30 are coupled to common connection point 18, which is coupled to radio circuit 7 via transmission line 6. Those structures remain unchanged from that shown in FIG. 1. The foregoing construction allows wireless device 31 to adjust respective resonant frequencies corresponding to first antenna element 23 and second antenna element 24 independently with ease.

As discussed above, the wireless device of the present invention has two feeding points corresponding to two antenna elements respectively and independently, so that a coupling loss between the two antenna elements can be reduced. On top of that, the wireless device has two matching circuits corresponding to the two antenna elements, respectively and independently, so that two independent resonant frequencies different from each other can be adjusted with ease. It is thus concluded that the present invention advantageously provides the foregoing wireless device having an antenna.

What is claimed is:

1. A wireless device comprising:

a first antenna element for resonating with a first frequency;

a first feeding point coupled to the first antenna element and disposed on a ground plane in the wireless device;

a first matching circuit, a first end of the first matching circuit being coupled to the first feeding point;

a second antenna element for resonating with a second frequency that is higher than the first frequency;

a second feeding point coupled to the second antenna element and disposed on the ground plane in the wireless device;

a second matching circuit, a first end of the second matching circuit being coupled to the second feeding point; and a radio circuit coupled via a transmission line to a common contact shared by a second end of the first matching circuit and a second end of the second matching circuit.

2. The wireless device of claim 1, wherein the second matching circuit comprises a capacitor coupled between the second feeding point and the common contact, and an inductor coupled between the second feeding point and the ground plane.

3. The wireless device of claim 1, further comprising insulating resin, wherein an antenna comprises the first antenna element and the second antenna element formed together with the insulating resin.

4. The wireless device of claim 1, wherein shapes of the first antenna element and the second antenna element are each one of linear, helical, meander, planar, and any combination thereof.

5. The wireless device of claim 1, wherein the first antenna element and the second antenna element are made of spring metal, wherein an end of the first antenna element is coupled to the first feeding point by pressure, and wherein an end of the second antenna element is coupled to the second feeding point by pressure.

* * * * *